US009839998B2

(12) United States Patent
Colletti et al.

(10) Patent No.: US 9,839,998 B2
(45) Date of Patent: Dec. 12, 2017

(54) CONTROL SYSTEM AND APPARATUS FOR POWER WRENCH

(71) Applicant: General Electric Company, Schenectady, NY (US)

(72) Inventors: Andrew Joseph Colletti, Greenville, SC (US); Srinivas Ravi, Simpsonville, SC (US); Minhajuddin Syed, Greer, SC (US)

(73) Assignee: General Electric Company, Schenectady, NY (US)

( * ) Notice: Subject to any disclaimer, the term of this patent is extended or adjusted under 35 U.S.C. 154(b) by 428 days.

(21) Appl. No.: 14/680,213

(22) Filed: Apr. 7, 2015

(65) Prior Publication Data

US 2016/0297056 A1 Oct. 13, 2016

(51) Int. Cl.

| | |
|---|---|
| ***B25B 21/00*** | (2006.01) |
| ***B25B 23/145*** | (2006.01) |
| ***B25B 23/14*** | (2006.01) |

(52) U.S. Cl.

CPC ..... *B25B 23/1456* (2013.01); *B25B 21/00* (2013.01); *B25B 21/005* (2013.01); *B25B 23/14* (2013.01); *B25B 23/145* (2013.01)

(58) Field of Classification Search

CPC ..... B25B 21/00; B25B 21/005; B25B 23/14; B25B 23/142; B25B 23/145; B25B 23/1456

(Continued)

(56) References Cited

U.S. PATENT DOCUMENTS 4,104,778 A * 8/1978 Vliet ..... B25B 23/1456 173/183
4,106,176 A * 8/1978 Rice ..... B25B 23/14 173/182

(Continued)

FOREIGN PATENT DOCUMENTS

DE 20 2004 020322 U1 11/2005
DE 10 2005 019258 A1 11/2006

(Continued)

OTHER PUBLICATIONS

Extended European Search Report and Opinion issued in connection with corresponding EP Application No. 6163755.8 dated Sep. 22, 2016.

*Primary Examiner* — Scott A. Smith
(74) *Attorney, Agent, or Firm* — Ernest G. Cusick; Hoffman Warnick LLC

(57) ABSTRACT

Embodiments of the present disclosure provide a control system including: a power wrench; and a controller operatively connected to the power wrench, wherein the controller is configured to perform actions including: directing an operative head of the power wrench to turn in response to a pressure-angle derivative of the operative head being below a predetermined threshold, defining an origin at an angular position of the operative head where the pressure-angle derivative of the operative head exceeds the predetermined threshold, directing the operative head to turn by an angular step in response to: the pressure-angle derivative of the operative head exceeding the predetermined threshold, and an angular differential of the operative head being less than a target value; and directing the operative head to cease turning in response to the angular differential of the operative head being approximately equal to or greater than the target value.

16 Claims, 6 Drawing Sheets

(58) Field of Classification Search
USPC ..... 173/2, 176, 180, 181, 183, 177, 182; 73/862.21, 862.23, 862.143, 862.26, 761; 81/463, 467, 429, 478
See application file for complete search history.

(56) References Cited

U.S. PATENT DOCUMENTS

| | | | | | |
|---|---|---|---|---|---|
| 4,361,945 | A * | 12/1982 | Eshghy | B23P 19/066 | 173/183 |
| 4,685,050 | A * | 8/1987 | Polzer | B25B 23/14 | 173/183 |
| 4,768,388 | A * | 9/1988 | Fader | B25B 23/142 | 702/43 |
| 4,941,362 | A * | 7/1990 | Tambini | B25B 23/145 | 73/862.23 |
| 4,995,145 | A * | 2/1991 | Eshghy | B25B 23/14 | 29/407.03 |
| 5,315,501 | A * | 5/1994 | Whitehouse | B23P 19/066 | 173/176 |
| 5,668,328 | A * | 9/1997 | Steber | B25B 21/005 | 73/862.23 |
| 6,161,629 | A * | 12/2000 | Hohmann | B23P 19/066 | 173/181 |
| 6,167,788 | B1 * | 1/2001 | Schonberger | B25B 23/14 | 73/862.23 |
| 6,212,763 | B1 * | 4/2001 | Newman | B25B 21/002 | 173/180 |
| 6,546,815 | B2 * | 4/2003 | Yamada | B25B 21/02 | 73/862.21 |
| 6,581,696 | B2 * | 6/2003 | Giardino | B25B 23/1405 | 173/1 |
| 6,782,594 | B2 | 8/2004 | Shoberg | | |
| 6,912,933 | B2 | 7/2005 | Knopp et al. | | |
| 7,000,486 | B2 * | 2/2006 | Wagner | B25B 21/005 | 73/862.21 |
| 7,467,669 | B2 * | 12/2008 | Friberg | B25B 23/1453 | 173/1 |
| 7,743,673 | B2 * | 6/2010 | Wagner | B25B 21/005 | 73/862.23 |
| 8,056,426 | B2 * | 11/2011 | Hohmann | B25B 21/005 | 73/862.23 |
| 8,171,827 | B2 * | 5/2012 | Gareis | B25B 21/00 | 81/469 |
| 8,280,639 | B2 * | 10/2012 | Conquergood | E21B 19/165 | 702/9 |
| 2004/0177704 | A1 * | 9/2004 | Wagner | B25B 21/005 | 73/862.21 |
| 2005/0210872 | A1 * | 9/2005 | Wagner | B25B 21/005 | 60/431 |
| 2007/0214921 | A1 * | 9/2007 | Fechter | B25B 21/005 | 81/467 |

FOREIGN PATENT DOCUMENTS

| | | | |
|---|---|---|---|
| EP | 0 170 068 | A2 | 2/1986 |
| EP | 0 297 515 | A1 | 1/1989 |
| WO | 03/013797 | A1 | 2/2003 |
| WO | 2004/035267 | A1 | 4/2004 |

* cited by examiner

CONTROL SYSTEM AND APPARATUS FOR POWER WRENCH

BACKGROUND OF THE INVENTION

The present disclosure relates generally to control systems and apparatuses which include or interact with a power wrench. More specifically, the present disclosure relates to systems and apparatuses with a controller for controlling the torqueing processes of a power wrench based on various conditions.

Two or more individual components of a machine assembly, such as those found in power generation systems, may be mechanically coupled to each other by the use of fastening elements, such as bolts wound onto threaded fasteners. These fastening elements, in a conventional process, can be installed manually by the use of tools such as wrenches, bolting devices, etc. During installation and service operations, acceptable margins of error for particular variables may be very small. One sensitive variable, known as "bolt stretch," can be defined as a bolt's amount of elongation from the surface of a reference component. Bolt stretch is one example of a variable which affects the operation and stability of the machine assembly.

To reduce the likelihood of human errors, some process steps for installing a fastening element can be automated. In one example, ultrasonic measuring instruments can partially automate some parts of an installation process, such as one of the processes discussed above. However, this approach may not be applicable or preferable for some types of machines. Providing greater accuracy and speed during construction, installation, and servicing of a machine assembly continues to be a technical challenge for particular applications.

BRIEF DESCRIPTION OF THE INVENTION

A control system and an apparatus for a power wrench are discussed herein. Although embodiments of the present disclosure are discussed by example by reference to power generation systems, it is understood that embodiments of the present disclosure may be applied to broadly to controlling a torqueing process for joining two or more components together.

A first aspect of the invention provides a system including: a power wrench; and a controller operatively connected to the power wrench, wherein the controller is configured to perform actions including: directing an operative head of the power wrench to turn in response to a pressure-angle derivative of the operative head being below a predetermined threshold, wherein the pressure-angle derivative is defined as a change in pressure against the operative head arising from a change to an angular position of the operative head of the power wrench, defining an origin at an angular position of the operative head where the pressure-angle derivative of the operative head exceeds the predetermined threshold, directing the operative head to turn by an angular step in response to: (a) the pressure-angle derivative of the operative head exceeding the predetermined threshold, and (b) an angular differential of the operative head being less than a target value, wherein the amount differential represents an total amount of rotation of the operative head from the origin; and directing the operative head to cease turning in response to the angular differential of the operative head being approximately equal to or greater than the target value.

A second aspect of the invention provides an apparatus including: a power wrench including an operative head for turning a rotatable workpiece; a pressure sensor operatively connected to the power wrench, the pressure sensor measuring a pressure against the operative head; an angular encoder operatively connected to the power wrench and configured to determine an angular position of one of the operative head and the rotatable workpiece relative to an origin; a controller operatively connected to the power wrench, the pressure sensor, and the angular encoder, wherein the controller is configured to: direct the operative head to turn in response to turn in response to a pressure-angle derivative of the operative head being below a predetermined threshold, wherein the pressure-angle derivative is defined as a change in pressure against the operative head arising from a change to an angular position of the operative head of the power wrench, define an origin at an angular position of the operative head where the pressure-angle derivative of the operative head exceeds the predetermined threshold, direct the power wrench to turn by an angular step in response to: (a) the pressure-angle derivative of the operative head exceeding the predetermined threshold, and (b) an angular differential of the operative head being less than a target value, wherein the angular differential represents an total amount of rotation of the operative head from the origin, and direct the operative head to cease turning in response to the angular differential of the operative head being approximately equal to or greater than the target value.

A third aspect of the invention provides a system including: a hydraulic wrench, wherein the hydraulic wrench further includes a hydraulic fluid pressure sensor, an angular encoder, an operative head for turning a rotatable workpiece; and a controller operatively connected to the hydraulic wrench and configured to perform actions including: turning the rotatable workpiece with the operative head in response to a pressure-angle derivative of the operative head being below a predetermined threshold, wherein the pressure-angle derivative is defined as a change in pressure against the operative head arising from a change to an angular position of the operative head of the power wrench, defining an origin at a position where the pressure-angle derivative of the operative head exceeds the predetermined threshold, turning the rotatable workpiece with the operative head by an angular step in response to: (a) the pressure-angle derivative of the power wrench exceeding the predetermined threshold, and (b) an angular differential of the operative head being less than a target value, wherein the angular differential represents an total amount of rotation of the operative head from the origin, and decoupling the operative head from the rotatable workpiece in response to the pressure-angle derivative of the operative head exceeding the predetermined threshold and the angular differential of the operative head from the origin being approximately equal to or greater than a target value.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
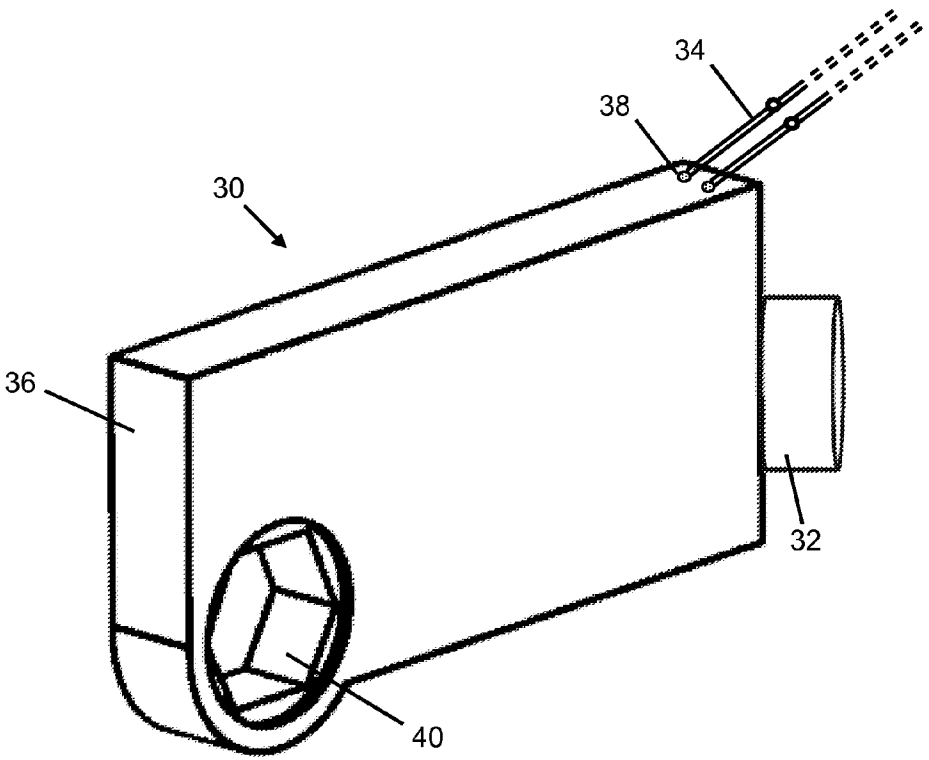
FIG. 1 provides a perspective view of a power wrench according to embodiments of the present disclosure.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As discussed herein, aspects of the present disclosure relate generally to control systems and apparatuses which include or interact with a power wrench. More specifically, aspects of the present disclosure relates to systems and apparatuses with a controller for controlling the torqueing processes of a power wrench based on various conditions.

Embodiments of the present disclosure generally include systems and apparatuses with a controller for directing a power wrench to perform particular actions, including steps for automatically rotating a rotatable workpiece such as a bolt. The term "power wrench" can be defined as a wrench powered at least in part by sources other than a human operator, and can include particular components for generating power such as electric, mechanical, hydraulic, and/or pneumatic power sources. In an example embodiment, a power wrench can be in the form of a hydraulic wrench with a hydraulically-actuated piston for powering an operative head of the power wrench, such as a torqueing ratchet.

Aspects of the present disclosure can include components for directing and/or otherwise manipulating a power wrench with an operative head for acting on a rotatable workpiece. A rotatable workpiece can include, e.g., a nut for interfacing with a threaded bolt, a screw or screw head, and/or another type of rotatable coupling component. Embodiments of the present disclosure can determine, e.g., by reference to a sensor such as a pressure sensor and/or angular encoder, an angular position where a change in pressure against the operative head of the power wrench relative to a corresponding change in the angular position of the rotatable workpiece reaches or exceeds a predetermined threshold. A predetermined threshold can represent, e.g., a pressure below which the torqueing operation can proceed through an initial torqueing phase where angular position is not significantly related to the pressure imparted against operative head of the power wrench. The predetermined threshold can optionally be calculated or determined by way of calibration for multiple workpiece configurations. Bolt stretch can be defined as an amount of elongation from the surface of a reference component. Embodiments of the present disclosure can define a reference point at an angular position where the predetermined threshold is exceeded. This reference point can be referred to as an origin. Embodiments of the present disclosure can then direct the operative head of the power wrench to turn the rotatable component by a particular amount of motion, known as an "angular step." The controller can continue to direct the operative head to turn by a particular number of angular steps until a target value of pressure against the operative head is met or exceeded. A full, three-hundred and sixty degree rotation of a rotatable workpiece can move the rotatable workpiece by a particular axial distance along a retaining fixture. For example, one full rotation of a nut can move the nut by approximately 3.0 millimeters axially along a threaded fastener. Although example amounts of movement, stretch, etc., are provided by example herein, it is understood that embodiments of the present disclosure can be calibrated for operation for varying dimensions. For instance, it is understood that the amount of axial movement by a rotatable workpiece corresponding to one full rotation may be on the order of magnitude of one one-thousandth of a millimeter (i.e., approximately 0.001 millimeters). By way of a known or predicted relationship between the position of a rotatable workpiece and the pressure against the rotatable workpiece, embodiments of the present disclosure can define a target pressure against the operative head. The target pressure can correspond to a desired amount of stretch and an amount by which the operative head has turned the rotatable workpiece. In addition, the amount of stretch resulting from a particular amount by which rotatable workpiece turns can be derived from a known pitch diameter of the threaded fastener. To further increase the accuracy of torqueing, embodiments of the present disclosure can also perform various processes for correcting the angular position of the rotatable workpiece by further movement of the operative head.

Referring to FIG. 1, a power wrench 30 can be provided in the form of, e.g., a torqueing device, powered at least in part by a component other than a human operator. As non-limiting examples, power wrench 30 can be powered wholly or partially by mechanical, electrical, hydraulic, and/or pneumatic power sources. In FIG. 1, power wrench 30 is shown by example as being a hydraulic wrench including a hydraulic cylinder 32. Hydraulic cylinder 32 can be mechanically coupled to a transmission (not shown) to provide mechanical torqueing based on action of hydraulic cylinder 32. Hydraulic lines 34 of power wrench 30 can provide a pressured hydraulic fluid to hydraulic cylinder 32 from a compressor. A body 36 of power wrench 30 can be coupled to hydraulic cylinder 32 by way of fasteners 38. Fasteners 38 can be in the form of, e.g., mechanical fixtures such as bolts, screws, and/or other types of connectors. Body 36 can include an operative head 40 for operating on a rotatable workpiece, e.g., by engaging and rotating the workpiece. In an example embodiment, the rotatable workpiece can be in the form of a crimped nut positioned upon and/or circumferentially engaging a threaded bolt. Operative head 40 is shown by example in FIG. 1 as including a substantially hexagonal cross-section, but it is understood that operative head 40 can be provided in the form of a component with a substantially circular, triangular, rectangular, octagonal, and/or other type of cross-section. In operation, hydraulic fluid provided to power wrench 30 through hydraulic lines 34 can actuate hydraulic cylinder 32 to turn operative head 40. A transmission (not shown) between hydraulic cylinder 34 and operative head 40 can convert the extension or retraction of hydraulic cylinder 32 into a torqueing action of operative head 40 by any currently known or later developed energy conversion or transmission techniques.

Figure 2:
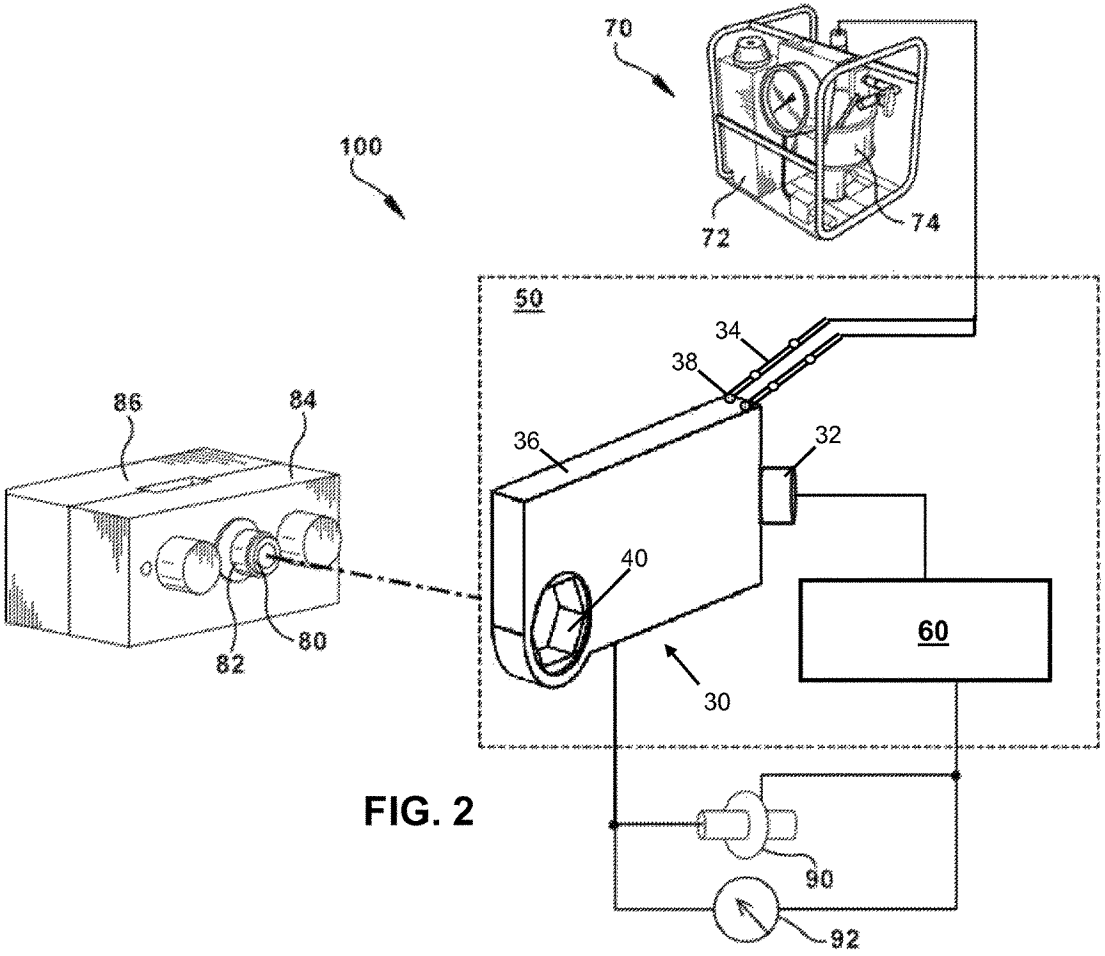
FIG. 2 depicts a system and apparatus according to embodiments of the present disclosure.

Turning to FIG. 2, a system 50 according to embodiments of the present disclosure is shown. System 50 can include power wrench 30 connected to other components, etc., as discussed herein. Power wrench 30 can be operatively connected to a controller 60 by any currently known or later developed form of operative connection between a wrench and a controller or similar device. For instance, power wrench 30 can be electrically or wirelessly connected (e.g., by paired receivers and transmitters) to controller 60 by way of a network or other operative connection by which instructions, information, etc., can be shared or transmitted between both components. Power wrench 30 and controller 60 can also be connected by ordinary wires, data couplings, etc. Several operative connections are discussed by example elsewhere herein. Controller 60 can generally include any type of computing device capable of performing operations by way of a processing component (e.g., a microprocessor) and as examples can include one or more computers, computer processors, electric and/or digital circuits, and/or similar components used for computing and processing electrical inputs. Various sub-components and operational characteristics of controller 60 are discussed in further detail elsewhere herein.

In embodiments where power wrench 30 is in the form of a hydraulic wrench, power wrench 30 can be coupled to and/or in fluid communication with a pump-reservoir assembly 70. Pump-reservoir assembly 70 can transmit hydraulic fluids into or out of power wrench 30 to control the action of components thereof, e.g., operative head 40. Pump-reservoir assembly 70 can include a reservoir 72 for storing a supply of hydraulic fluid for operating power wrench 30. A pump 74 of pump-reservoir assembly 70 can govern the transmission of hydraulic fluid between power wrench 30 and pump-reservoir assembly 70. Pump 74 can be powered by, e.g., a motor such as an electric motor, a combustion engine, etc., mechanically coupled to pump 74 through a rotatable shaft, or can be powered by any other currently known or later developed device, technique, etc. for generating or transmitting energy. Controller 60 can directly or indirectly manipulate power wrench 30. For example, controller 60 can relay instructions to activate, deactivate, or otherwise adjust valves within power wrench 30 to control the position of hydraulic cylinder 32 and/or the amount of power, fuel, operating fluid (e.g., hydraulic fluid), etc., flowing into or out of power wrench 30 through hydraulic lines 34 connected to pump reservoir assembly 70.

Power wrench 30 of system 50 can operate upon a rotatable workpiece 80. Rotatable workpiece 80 can be mounted, for example, upon a bolt 82 extending through a first component 84 and a second component 86. In an embodiment, bolt 82 can be a threaded bolt and first and second components 84, 86, can be structural components or sub-components of a larger assembly configured to be fastened to each other. Rotatable workpiece 80 can be embodied as a nut rotated about bolt 82, and more specifically may be a crimped nut which includes projecting fixtures for preventing movement of rotatable workpiece 80 away from first and second components 84, 86. Operative head 40 of power wrench 30 can be positioned upon rotatable workpiece 80 to impart torque. Operative head 40 can turn rotatable workpiece 80 about bolt 82. Initially, the change in pressure against operative head 40 as rotatable workpiece 80 rotates can be approximately zero. Rotatable workpiece 80 may contact first component 84 after a particular amount of turning occurs. Physical contact between rotatable workpiece 80 and first component 84 may impart greater pressure against operative head 40 as rotatable workpiece 80 continues to rotate about bolt 82. More specifically, contact between rotatable workpiece 80 and first component 84 can create an opposing tensile force, thereby requiring operative head 40 to impart greater torque against rotatable component 80 to continue turning rotatable component 80. These types of forces can be known as and referred to as "anti-rotation," and in summary can be any force which acts against the turning of rotatable workpiece 80 by operative head 30. As discussed herein, controller 60 can determine the amount of torqueing to apply to rotatable workpiece 80 through power wrench 30 based on the pressure imparted against power wrench 30 and the position of rotatable workpiece 80 relative to a defined origin.

The various components and devices discussed herein can together form an apparatus 100 according to embodiments of the present disclosure. Apparatus 100 can include power wrench 30 with operative head 40 for turning rotatable workpiece 80. Power wrench 30 can also be operatively connected to controller 60, an angular encoder 90, and a pressure sensor 92. Where power wrench 30 is in the form of a hydraulic wrench, apparatus 100 can also include pump-reservoir assembly 70 connected to power wrench 30.

As discussed in further detail herein, controller 60 can control the operation of power wrench 30 based on, e.g., the pressure imparted by rotatable workpiece 80 against operative head 40 and the angular position of operative head 40. In a first or initial phase, controller 60 can direct power wrench 30 to turn (e.g., by rotating operative head 40) in response to a pressure-angle derivative of power wrench 30 being below a predetermined threshold. As used herein, the term "pressure-angle derivative" can be defined mathematically as the change in pressure imparted against operative head 40 divided by a corresponding change in the angular position of operative head 40. In an example, the pressure-angle derivative may be close to or approximately zero where operative head 40 turns rotatable workpiece 80 without being opposed by significant reactionary mechanical forces. For example, before rotatable workpiece 80 contacts first component 84, turning rotatable workpiece 80 by approximately ten degrees with operative head 40 can cause the pressure against operative head 40 to remain constant. In a contrasting example, the pressure-angle derivative may increase at the point where rotatable workpiece 80 on bolt 82 contacts first component 84 when being turned by operative head 40. The pressure-angle derivative meeting or exceeding a particular positive value (i.e., a predetermined threshold) can correspond to bolt 82 contacting first component 84. In an illustrative example, the predetermined of the pressure-angle derivative can be approximately 30 pascals (Pa) per degree of rotation.

Where the pressure-angle derivative exceeds the value of the predetermined threshold, controller 60 can define an origin of operative head 40 and/or rotatable workpiece 80. The origin can correspond to a position at which the pressure-angle derivative of operative head 40 exceeds a predetermined threshold. For instance, a user may wish to define the origin where rotatable workpiece 80 contacts first component 84. At this point, opposing mechanical forces, e.g., tensile forces imparted against operative head 40 from first component 84, can cause rotation of rotatable workpiece 80 along bolt 82 to become more difficult. When these forces cause the pressure-angle derivative to exceed the predetermined threshold (e.g., 30 Pa per degree of rotation), controller 60 define the origin at this position before torqueing continues. At the origin, controller 60 can direct operative head 40 to turn incrementally by a predetermined "angular step." The angular step can be a discrete amount of rotation for imparting a particular increase in pressure, e.g., turning rotatable workpiece 80 by approximately one-hundred and twenty degrees to cause a corresponding increase in pressure of approximately four kilopascals (kPa). Controller 60 can direct operative head 40 to turn rotatable workpiece 80 by the angular step successively until the angular position of rotatable workpiece 80 with respect to the origin reaches a target value. The target value can correspond to a particular amount of rotation from the origin. In addition or alternatively, the target value can correspond to a desired amount of stretch of bolt 82 from first component 84, determined by reference to the amount of rotation from the origin. For example, the target position may be an approximately six-hundred degree rotation of rotatable workpiece 80 from the origin, which in turn can cause bolt 82 to stretch approximately 3.0 millimeters from rotatable workpiece 80. When operative head 40 and/or rotatable workpiece 80 reaches the target value, controller 60 can direct power wrench 30 to cease turning and/or decouple from workpiece 80.

Embodiments of the present disclosure can also include, e.g., an angular encoder 90 and a pressure sensor 92. Angular encoder 90 can be in the form of a disc-type angular encoder and/or any other currently known or later developed type of encoder which measures or derives the angular position or movement of a rotating element with respect to an origin. More specifically, angular encoder can convert the angular position of a rotatable disc into an electrical signal provided to controller 60. Angular encoder 90 can be operatively connected to power wrench 30. More specifically, the rotation of operative head 40 can be mechanically linked to the rotation of disc-type components in angular encoder 90. The operation of angular encoder 90 can measure, e.g., the angular position of operative head 40 with respect to the origin. To determine the amount of rotation with respect to the defined origin, controller 60 can define a position of angular encoder 90 as being zero at the origin, the pressure-angle derivative of operative head 40 first exceeds the predetermined threshold. Angular encoder 90 can be embedded within power wrench 30 as a component thereof, or can be provided as a separate component external to power wrench 30 and controller 60.

Pressure sensor 92 can be embodied as a general purpose pressure sensor or an internal pressure sensor of power wrench 30. As non-limiting examples, pressure sensor 92 can be in the form of a mechanical pressure gauge, an electrical pressure transducer, a piezoelectric pressure sensor, an optical pressure sensor, a resonant pressure gauge, etc. Where power wrench 30 is in the form of a hydraulic wrench, pressure sensor 92 can be in the form of a wrench driving fluid pressure sensor. More specifically, pressure sensor 92 can directly measure pressures imparted by a hydraulic fluid of power wrench 30 (i.e., water, oil, synthetic fluids, etc.). In any event, pressure sensor 92 can determine an amount of pressure imparted against power wrench 30 from rotatable workpiece 80. Similar to angular encoder 90, pressure sensor 92 can be positioned within power wrench 30 or can be provided as an external component. In any event, controller 60 can be operatively connected to angular encoder 90 and pressure sensor 92. Controller 60 can read and/or otherwise receive determined values of pressure operative head 40.

Figure 3:
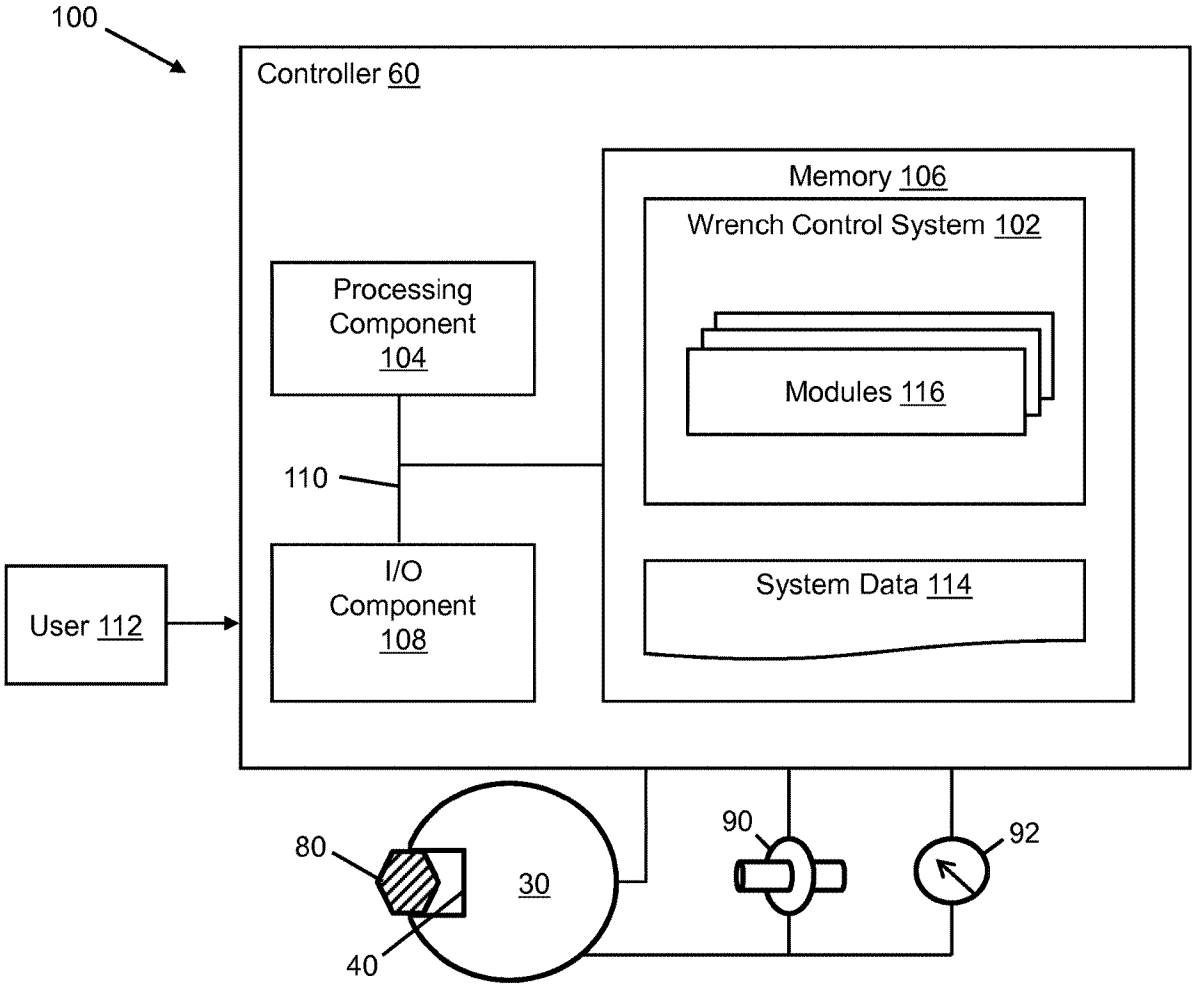
FIG. 3 depicts an illustrative environment which includes a controller interacting with a power wrench and rotatable workpiece according to embodiments of the present disclosure.

FIG. 3 provides a schematic illustration of apparatus 100 including controller 60 operatively connected to power wrench 30 and rotatable workpiece 80 according to embodiments. To this extent, apparatus 100 includes controller 60 for performing processes to direct the operation of power wrench 30, and/or associated systems and components. Although power wrench 30 is discussed by example herein as being a hydraulic wrench, it is understood that power wrench 30 can be embodied as any currently known or later developed type of power wrench. Further, it is understood that apparatus 100 with controller 60 can be used with one or more rotatable workpieces 80. Controller 60 is shown as including a wrench control system 102, which makes controller 60 operable to direct power wrench 30 and/or associated systems and tools described herein for implementing any/all of the embodiments described herein. In operation, wrench control system 102 can issue electrical commands, which in turn may be converted into mechanical actions (e.g., turning operative head 40 of power wrench 30) in response to particular conditions. The conditions for turning operative head 40 can include, e.g., a pressure-angle derivative of power wrench 30 relative to rotatable workpiece 80 being above or below a predetermined threshold, rotatable workpiece 80 reaching a target position, a pressure against operative head 40 being outside of a tolerance band of pressures, etc.

Controller 60 is shown including a processing component 104 (e.g., one or more processors), a memory 106 (e.g., a storage hierarchy), an input/output (I/O) component 108 (e.g., one or more I/O interfaces and/or devices), and a communications pathway 110. In an embodiment, processing component 104 may execute program code, such as wrench control system 102, which is at least partially fixed in memory 106. While executing program code, processing component 104 can process data, which can result in reading and/or writing transformed data from/to memory 106 and/or I/O component 108 for further processing. Pathway 110 provides a communications link between each of the components in controller 60. I/O component 108 can comprise one or more human I/O devices, which enable a human or system user 112 to interact with controller 60 and/or one or more communications devices to enable user(s) 112 to communicate with controller 60 using any type of communications link. To this extent, wrench control system 102 can manage a set of interfaces (e.g., graphical user interface(s)) that enable user(s) 112 to interact with wrench control system 102. Further, wrench control system 102 can manage (e.g., store, retrieve, create, manipulate, organize, present, etc.) data, such as system data 114 (including recorded pressures, angular positions, etc.) using any solution.

In any event, controller 60 can comprise one or more general-purpose or specific-purpose computing articles of manufacture (e.g., computing devices) capable of executing program code, such as wrench control system 102, installed thereon. As used herein, it is understood that "program code" means any collection of instructions, in any language, code or notation, that cause a computing device having an information processing capability to perform a particular function either directly or after any combination of the following: (a) conversion to another language, code or notation; (b) reproduction in a different material form; and/or (c) decompression. To this extent, wrench control system 102 can be embodied as any combination of system software and/or application software.

Further, wrench control system 102 can be implemented using a set of modules 116. In this case, each module can enable controller 60 to perform a set of tasks used by wrench control system 102, and can be separately developed and/or implemented apart from other portions of wrench control system 102. A comparator module can compare two or more mathematical quantities, such as measured and/or pre-calculated values. A calculator module can perform mathematical operations, such as adding, subtracting, multiplying, dividing, etc., on data. A determinator module can make determinations based on results yielded by other operations performed with controller 60 and/or rules defined in an algorithm. When fixed in memory 106 of controller 60 that includes processing component 104, a module is a substantial portion of a component that implements the functionality. Regardless, it is understood that two or more components, modules and/or systems may share some/all of their respective hardware and/or software. Further, it is understood that some of the functionality discussed herein may not be implemented or additional functionality may be included as part of controller 60.

Regardless, controller 60 can include multiple computing devices, and the computing devices can communicate over any type of communications link. Further, while performing a process described herein, controller 60 can communicate with one or more other computer systems using any type of communications link. In either case, the communications link can comprise any combination of various types of wired and/or wireless links; comprise any combination of one or more types of networks; and/or use any combination of various types of transmission techniques and protocols. In other embodiments, using system 50 and/or apparatus 100 can provide for manual operation of controller 60 (e.g., via user(s) 112 such as one or more technicians) or automatic operation of controller 60 by the intervention of one or more computer systems operatively connected thereto. It is understood that controller 60 may serve technical purposes in other settings beyond providing a control system or apparatus for a power wrench, including without limitation: inspection, maintenance, repair, replacement, testing, etc.

When controller 60 comprises multiple computing devices, each computing device may have only a portion of wrench control system 102 fixed thereon (e.g., one or more modules). However, it is understood that controller 60 and wrench control system 102 are only representative of various possible equivalent computer systems that may perform a process described herein. To this extent, in other embodiments, the functionality provided by controller 60 and wrench control system 102 can be at least partially implemented by one or more computing devices that include any combination of general and/or specific purpose hardware with or without program code. In each embodiment, the hardware and program code, if included, can be created using standard engineering and programming techniques, respectively.

Wrench control system 102 can be in the form of a computer program fixed in at least one computer-readable medium, which when executed, enables controller 60 to direct the operation of power wrench 30. To this extent, the computer-readable medium includes program code which implements some or all of the processes and/or embodiments described herein. It is understood that the term "computer-readable medium" comprises one or more of any type of tangible medium of expression, now known or later developed, from which a copy of the program code can be perceived, reproduced or otherwise communicated by a computing device. For example, the computer-readable medium can comprise: one or more portable storage articles of manufacture; one or more memory/storage components of a computing device; paper; etc.

Figure 4:
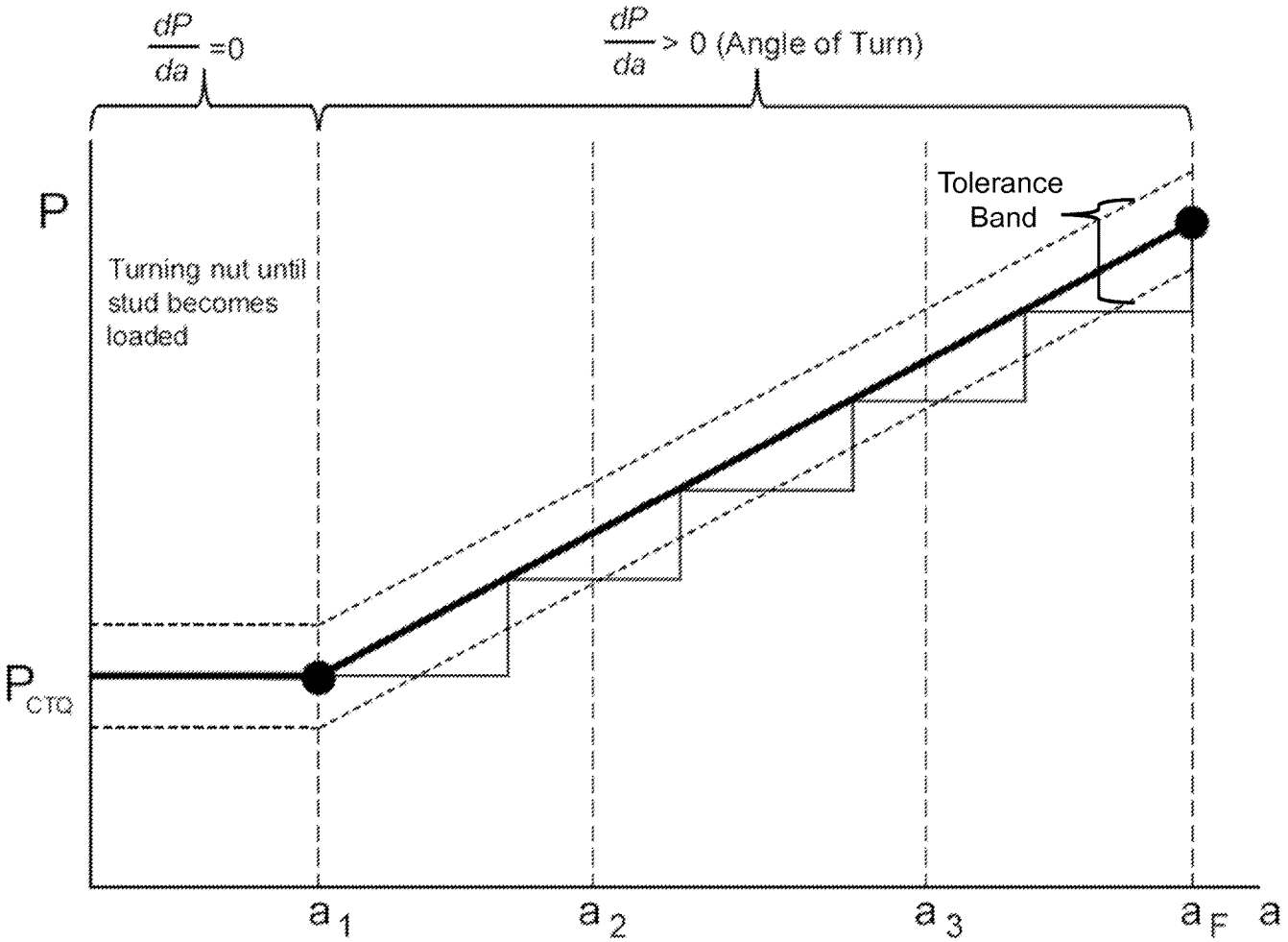
FIG. 4 depicts a plot of pressure "P" against an operative head of a power wrench versus angular position "a" of the operative head according to an example embodiment of the present disclosure.

Referring to FIG. 4, an example chart of pressure "P" imparted against operative head 40 (FIGS. 1-3) of power wrench 30 (FIG. 1-3) versus angular position "a" of operative head 40 is shown as a further illustration. In the example of FIG. 4, rotatable workpiece 80 is in the form of a nut being wound onto a stud, where the stud joins two components (e.g., first and second components 84,86 (FIG. 2)) of a structure. Initially, a pressure against operative head 40 during the turning of rotatable workpiece 80 can have a value $P_{CTQ}$ which does not increase as rotatable workpiece 80 continues to rotate. This process stage, in which pressure against operative head 40 does not significantly increase before reaching angle $a_1$, can be known and referred to as "initial torqueing." During initial torqueing, the pressure-angle derivative (represented as dP/da) can be zero because rotatable workpiece 80 contacts only operative head 40 and bolt 82. As operative head 40 continues to move rotatable workpiece 80 along bolt 82, forces against operative head 40 from other sources (e.g., friction between bolt 82 and rotatable workpiece 80) can be negligible.

Where rotatable workpiece 80 becomes "loaded" (i.e., rotatable workpiece 80 in the form of a rotating nut contacts first component 84 in this example), the pressure-angle derivative becomes greater than zero and meets the predetermined threshold. In an example, rotatable workpiece 80 can contact first component 84 to impart a bolting force as rotatable workpiece 80 continues to move along bolt 82. This stage of torqueing can be known and referred to as the "angle of turn operation." Wrench control system 102 (FIGS. 2-3) of controller 60 can define an origin for further torqueing of rotatable workpiece 80 in response to the pressure-angle derivative being exceeded at angle $a_1$. As operative head 40 turns rotatable workpiece 80 and moves consecutively from angle $a_1$ to angle $a_2$ to angle $a_3$, and eventually to $a_F$, the pressure imparted against operative head 40 can increase as operative head 40 turns rotatable workpiece. The increase in pressure imparted against operative head 40 can derive from opposing forces imparted by first component 84 against operative head 40 through rotatable workpiece 80. The opposing forces can result from first and second components 84, 86 contacting each other and being pressed against each other by rotatable workpiece 80, thereby causing the pressure-angle derivative to become greater than zero. Each labeled change in angle of operative head 40 can correspond to a single "angular step." Angle $a_f$ can represent a target position where rotatable workpiece 80 reaches an angular differential ($a_F$-$a_1$) with respect to the origin ($a_1$). At angle $a_f$, rotatable workpiece 80 can be in a target position. In the example shown in FIG. 4, the pressure against operative head 40 can be within a tolerance band of pressures. In other embodiments discussed herein, controller 60 can instruct operative head 40 to correct the position of rotatable workpiece 80 when the pressure against operative head 40 is outside the tolerance band. As is illustrated in FIG. 4, controller 60 in embodiments of the present disclosure can direct operative head 40 of power wrench 30 to turn rotatable workpiece 80 according to the process steps described herein, to provide automatic torqueing of rotatable workpiece 80.

Figure 5:
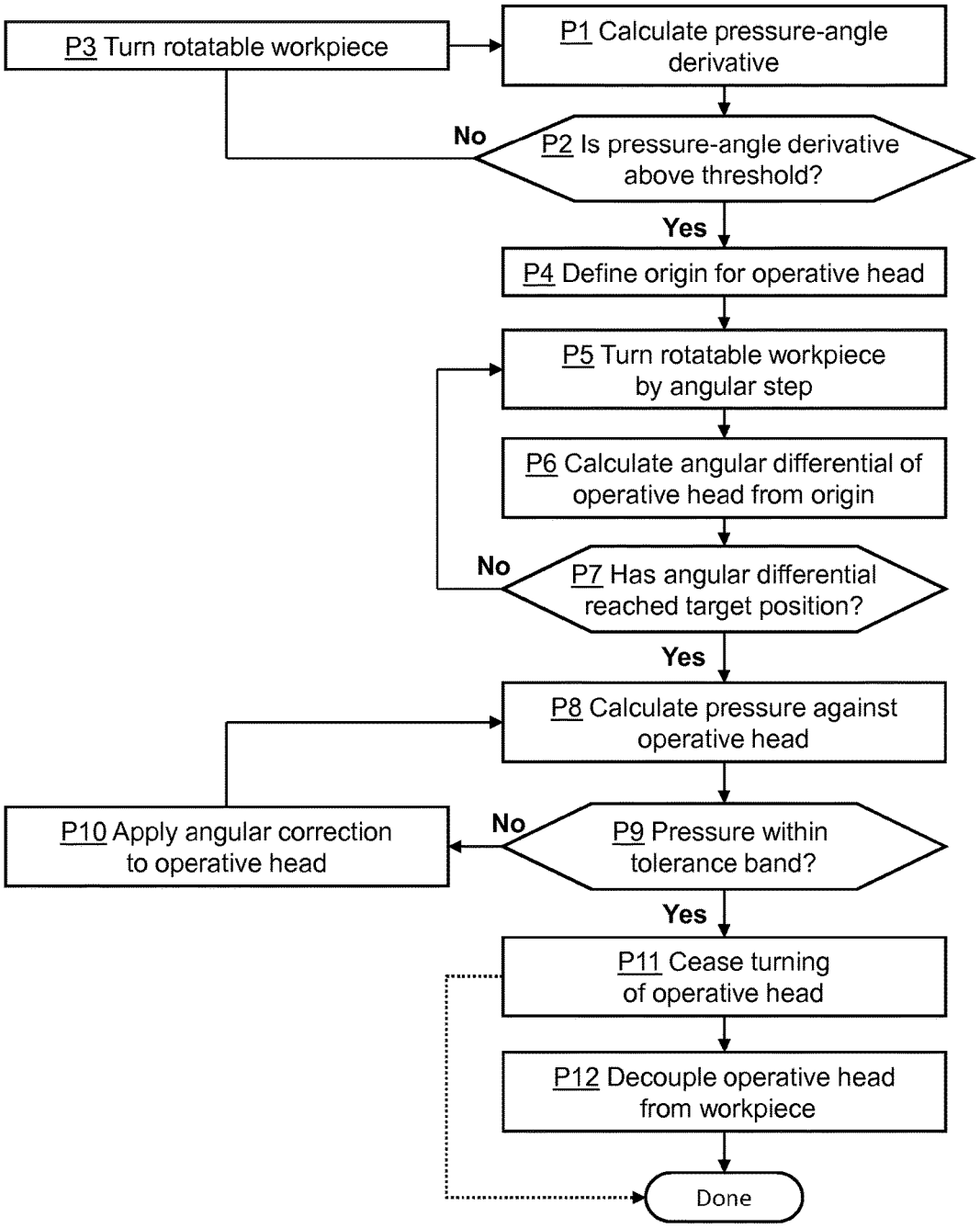
FIG. 5 provides a representative flow diagram of process steps performed with a controller according to embodiments of the present disclosure.
Figure 6:
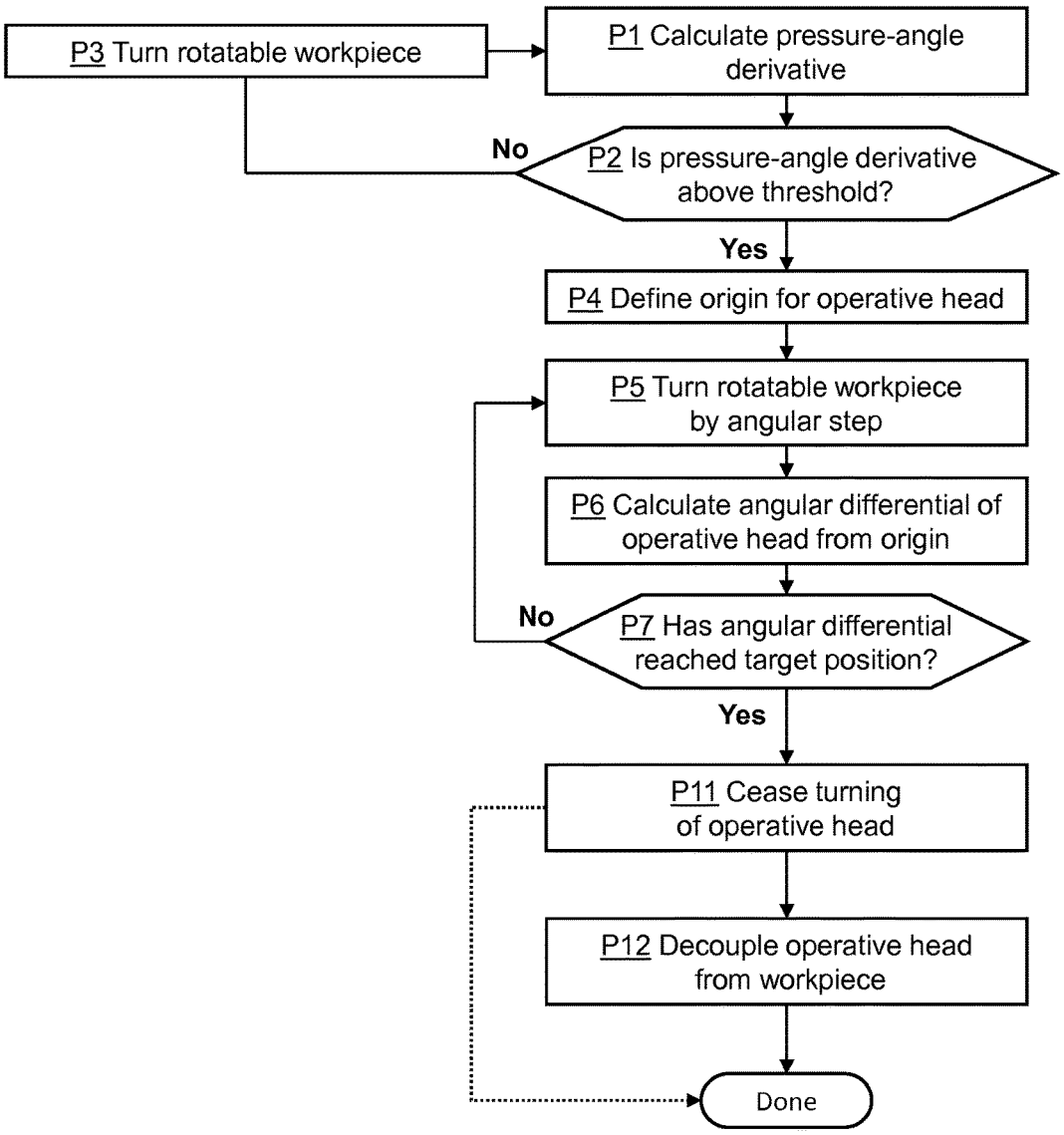
FIG. 6 provides a representative flow diagram of another group of process steps performed with a controller according to embodiments of the present disclosure.

Referring to FIGS. 3 and 5 together, an illustrative method flow diagram is shown according to embodiments of the present disclosure. A different process flow is also shown in FIG. 6. The process flows shown in FIGS. 5 and 6, may apply, e.g., to torqueing operations where rotatable workpiece 80 is in the form of a crimped nut of a power generation system. However, it is understood that the example process flow discussed herein can be modified to suit alternative applications. Processes according to the present disclosure are described herein by reference to an example of torqueing operations for two components of a turbine system, and a plot of torqueing operations in this example is shown in FIG. 4. More specifically, the process flow can provide for torqueing of rotatable workpiece 80 along bolt 82 to join first and second components 84, 86 of a turbine system. However, it is understood that the example discussed herein is non-limiting, and that embodiments of the present disclosure can be applied to other settings with or without modifications.

At process P1, wrench control system 102 can calculate the value of a pressure-angle derivative (dP/da) of power wrench 30 for a particular instance. As is discussed elsewhere herein, the pressure-angle derivative generally refers to a change in pressure against power wrench 30 relative to a corresponding change to an angular position of operative head 40 of power wrench 30. The pressure-angle derivative is represented graphically in FIG. 4 as the slope of the plot of pressure versus angular position. In an embodiment, modules 116 can calculate the pressure-angle derivative in process P1 from values of pressure from pressure sensor 92 relative to corresponding changes in angular position measured with angular encoder 90. According to an example, modules 116 can calculate the pressure-angle derivative by dividing a change in pressure against operative head 40, measured with pressure sensor 92, by a corresponding change in angular position of operative head 40, measured with angular encoder 90.

At process P2, modules 116 can compare the pressure-angle derivative calculated in process P1 with the predetermined threshold. Where the comparison indicates the pressure-angle derivative as below the predetermined threshold (i.e., "no" at process P2), the flow can proceed to a process P3 where controller 60 directs operative head 40 to turn rotatable workpiece 80. To turn rotatable workpiece 80 in process P3, controller 60 can instruct operative head 40 to turn a constant speed for a particular amount of time, turn for a particular angular distance, and/or provide other instructions for turning operative head 40 by a particular amount of rotation. Where controller 60 directs operative head 40 to turn rotatable workpiece 80 in process P3, the flow can return to process P1 where wrench control system 102 can again calculate the pressure-angle derivative. Although process P3 can be executed sequentially following each comparison in process P1 and determination in process P2, it is understood that process P3 can occur simultaneously or substantially simultaneously with processes P1 and P2. In an example embodiment, rotatable workpiece 80 may not yet be in contact with first component 84. In this case, modules 116 can calculate a pressure-angle derivative of approximately zero in response to rotatable workpiece 80 being rotated by approximately ten degrees, and thereby causing a negligible increase in pressure against operative head 40 (e.g., a pressure increase of less than one Pa). Where the predetermined threshold is approximately zero, a negligible (i.e., less than the predetermined threshold of 30 Pa per degree of rotation) pressure-angle derivative would not exceed the predetermined threshold.

Where the pressure-angle derivative exceeds the predetermined threshold (i.e., "yes" at process P2), the flow can proceed to a process P4 for defining an origin as a reference position of angular displacement for operative head 40. The pressure-angle derivative exceeding the predetermined threshold can indicate where rotatable workpiece 80 contacts another component (e.g., first component 84). This contact can cause tensile forces exerted from first component 84 to oppose further turning of rotatable workpiece 80. In addition, other forces such as friction between the contacting surfaces of rotatable workpiece 80 and first component 84 can impede further torqueing. According to an example, modules 116 can calculate a pressure-angle derivative of 33 Pa per degree based on the pressure against operative head 40 increasing by approximately 330 Pa after rotatable workpiece 80 rotates by approximately ten degrees. Where the predetermined threshold is approximately 30 Pa per degree, a pressure-angle derivative of 33 Pa per degree exceeds the predetermined threshold of 30 Pa per degree.

At process P4, modules 116 of wrench control system 102 can define an origin, e.g., by recording a position of angular encoder 90 where the pressure-angle derivative exceeds the predetermined threshold. The origin defined with controller 60 can designate a value of zero angular displacement of operative head 40, at the beginning of the angle of turn operation. As a result of the pressure-angle derivative being exceeded, wrench control system can switch to the angle of turn operation, where among other things controller 60 can instruct power wrench 30 to rotate rotatable workpiece 80 by a particular amount, i.e., by a predetermined angular step. According to the example discussed herein, wrench control system 102 can instruct operative head 40 to turn rotatable workpiece 80 by an angular step of approximately one hundred and twenty degrees.

At process P5, controller 60 can direct operative head 40 of power wrench 30 to turn rotatable workpiece 80 by the amount of a predetermined angular step. The angular step can refer to an instance of angular movement measured by an amount (e.g., in degrees, radians, centimeters, etc.) which imparts an incremental increase in pressure against operative head 40. This incremental increase in pressure against operative head 40 can be known as and referred to as a pressure differential. The angular step may be defined by user 112 and/or stored within memory 106 of controller 60 (e.g., as system data 114). In an illustrative example, the angular step can be a rotation of approximately one hundred and twenty degrees, with a corresponding pressure differential of approximately 4.0 kilopascals (kPa).

At process P6, modules 116 can calculate an angular differential between the current position of operative head 40 and the origin defined in process P4. For example, modules 116 can subtract an angular measurement for the origin from an angular measurement representing the current position of operative head 40. In an example embodiment, a data exchange module 122 can read and/or otherwise receive angular position data from angular encoder 90, e.g., as system data 114. According to the example discussed herein, modules 116 can calculate an angular differential of approximately three-hundred and sixty degrees (i.e., one full turn) after operative head 40 turns rotatable workpiece 80 by the angular step (i.e., by one hundred and twenty degrees) for the third time.

At process P7, modules 116 can compare whether the angular differential calculated in process P6 is approximately equal to or otherwise greater than the angular differential for a target position. The target position refers to a desired position where operative head 40 has rotated from the defined origin by a particular amount, and where operative head 40 may be subject to a desired amount of pressure. The target location can be a location where rotatable workpiece 80 provides a corresponding elongation of bolt 82 from first component 84. In an embodiment, the target position may be a position where the position of rotatable workpiece 80 creates a desired amount of stretch, e.g., a predetermined bolt stretch of bolt 82 (FIG. 2). The desired amount of stretch may be calculated based on a correlation between the turning of rotatable workpiece 80 and a change in the amount of stretch. For example, a particular rotatable workpiece 80 moving along bolt 82 may cause stretch to increase by, e.g., approximately 0.50 millimeters for each one-hundred degrees that rotatable workpiece 80 turns. Where the angular differential has not reached the angular differential for the target position (i.e., "no" at process P7), the flow can return to process P5 of again turning rotatable workpiece 80 with operative head 40 by the value of the angular step. In the example scenario, a target position for rotatable workpiece 80, stored in memory 106 of controller 60, can be approximately six-hundred degrees from the origin, which in turn can correspond to approximately 3.0 millimeters of bolt stretch. Where the angular differential is less than six hundred degrees, controller 60 can instruct operative head 40 to turn by another angular step.

Where the angular differential is approximately equal to or greater than the target position (i.e., "yes" at process P7), the flow can proceed to a process P8 where wrench control system 102 calculates the amount of pressure exerted against operative head 40. In an embodiment, modules 116 can calculate the pressure imparted against operative head 40 by reference to measurements obtained with pressure sensor 92. More particularly, pressure sensor 92 can measure the amount of pressure imparted against operative head 40 and transmit these values to wrench control system 102. In the example, rotatable workpiece 80 being in the target position (i.e., with an angular differential of approximately six-hundred degrees from the origin) may cause operative head 40 to experience a pressure of, e.g., approximately 25 kPa from rotatable workpiece 80. In this case, the pressure of 25 kPa may be greater than the predicted or desired amount of pressure against operative head 40 in the target position.

In process P9, modules 116 can compare the pressure against operative head 40, calculated in process P8, with a range of highest and lowest acceptable pressures, otherwise known as a "tolerance band." The pressure value(s) being compared with the tolerance band can be measured with and/or received from pressure sensor 92, or can be transmitted to controller 60 by any currently known or later developed process. The tolerance band can represent an acceptable margin of error for the torqueing of rotatable workpiece 80, and can be determined by constraints of a particular application or user preference. For example, the tolerance band can represent a maximum difference in actual pressure and a target pressure in terms of percentage points, e.g., up to ten percent above or below a target pressure. Returning to the example, modules 116 may calculate a desired pressure against operative head 40 at the target the position as being approximately 20 kPa, with the tolerance band being 2.0 kPa above or below this pressure (i.e., between approximately 18 kPa and approximately 22 kPa).

Where the pressure against operative head 40 is outside the tolerance band (i.e., "no" at process P9), controller 60 can direct power wrench 30 to apply an angular correction in process P10. The angular correction can generally include further adjustment of rotatable workpiece 80, e.g., by turning operative head 40 by a particular number of degrees in a positive or negative direction relative to the origin defined in process P4. Process P10 can thus correct for discrepancies between a desired pressure and an actual pressure when operative head 40 of power wrench 30 reaches the target position. According to the example, a pressure of approximately 25 kPa would be above the tolerance band by approximately 3.0 kPa. Controller 60 in process P10 can instruct operative head 40 to turn rotatable workpiece 80 in the opposite (i.e., negative) direction by a desired amount, e.g., by increments of thirty degrees, until the pressure against operative head 40 is within the tolerance band (i.e., between approximately 18 kPa and approximately 22 kPa).

Where the pressure against operative head 40 is within the tolerance band (i.e., "yes" at process P9), the flow can proceed to a process P11 where controller 60 directs power wrench 30 to cease turning. Following process P11, the flow can optionally proceed to a process P12 where controller 60 directs power wrench 30 to decouple operative head 40 from rotatable workpiece 80. In the example, controller 60 can direct power wrench 30 to decouple from rotatable workpiece 80 after the pressure against operative head 40 is between approximately 18 kPa and approximately 22 kPa. Alternatively, the method can complete (i.e., "done") without the decoupling in process P12 as shown by the corresponding phantom process flow. Where operative head 40 is decoupled from rotatable workpiece 80 in process P12, the process flow can end (i.e., "done") after the decoupling.

Turning briefly to FIG. 6, an alternative process flow methodology is shown. Here, the correcting operations in processes P8 through P10 can be skipped entirely. More specifically, where the angular differential is approximately equal to or greater than the target position, controller 60 can immediately instruct operative head 40 of power wrench 30 to cease turning. The process flow shown in FIG. 6 may be applicable to applications where correcting processes are not desired, or where the pressure against operative head 40 is within the tolerance band immediately after rotatable workpiece 80 reaches the target position. For instance, the process flow of FIG. 6 may apply where the pressure against operative head 40 is between approximately 18 kPa and approximately 22 kPa when operative head 40 reaches the target position (i.e., reaches an angular differential from the origin of approximately six-hundred degrees).

The apparatus and method of the present disclosure is not limited to installation or servicing operations performed on power generation systems, and may be applicable to other machines. In the case of a power generation system, embodiments of the disclosure are not limited to the torqueing of components within any one system, e.g., any particular gas turbine, steam turbine, power generation system or other system, and may be used with other power generation systems and/or systems (e.g., combined cycle, simple cycle, nuclear reactor, etc.). Additionally, the apparatus of the present invention may be used with other systems not described herein that may benefit from the increases to operational range, efficiency, durability, and reliability provided by embodiments of the present disclosure.

Technical effects of the present disclosure can include full automation of a power wrench during bolting, fastening, and/or other torqueing processes and/or other fastening process. As opposed to a multi-step process with only partial automation, embodiments of the present disclosure can provide a unified procedure by which a rotatable workpiece is first wound onto a fixture before angle of turn operations begin. The angle of turn operations can be performed by reference to an automatically determined point of origin. In addition, embodiments of the present disclosure introduce the ability to measure bolt stretch and/or identify a point of origin for a rotatable workpiece by reference to rates of change (e.g., a pressure-angle derivative). Embodiments of the present disclosure can also reduce the time required for torqueing processes, and can provide greater consistency of torqueing by repeated application of a particular algorithm or group of algorithms.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

a power wrench; and a controller operatively connected to the power wrench, wherein the controller is configured to perform actions including:

directing an operative head of the power wrench to turn in response to a pressure-angle derivative of the operative head being below a predetermined threshold, wherein the pressure-angle derivative is defined as a change in pressure against the operative head arising from a change to an angular position of the operative head of the power wrench, defining an origin at an angular position of the operative head where the pressure-angle derivative of the operative head exceeds the predetermined threshold, directing the operative head to turn by an angular step in response to:

(a) the pressure-angle derivative of the operative head exceeding the predetermined threshold, and (b) an angular differential of the operative head being less than a target value, wherein the angular differential represents an total amount of rotation of the operative head from the origin; and directing the operative head to cease turning in response to the angular differential of the operative head being approximately equal to or greater than the target value, wherein the controller is further configured to perform actions including:

determining whether the pressure against the operative head is outside a tolerance band in response to the angular differential being approximately equal to or greater than the target value, and directing the operative head to turn by an angular correction in response to the pressure against the operative head being outside the tolerance band.

2. The system of claim 1, wherein the tolerance band comprises a pressure differential of at most approximately ten percent from a target pressure.

3. The system of claim 1, wherein the power wrench comprises a hydraulic wrench.

4. The system of claim 1, wherein the angular step comprises one of a plurality of angular steps, each of the plurality of angular steps imparting a predetermined pressure differential onto the power wrench.

5. The system of claim 1, wherein the rotatable workpiece includes one of a locking nut and a non-locking nut of a turbine assembly.

6. The system of claim 1, further comprising a pressure sensor operatively connected to the power wrench for determining the pressure against the operative head.

7. The system of claim 1, further comprising an angular encoder operatively connected to the power wrench for determining the angular position of the operative head relative to the origin.

8. The system of claim 1, wherein the target value of the angular differential corresponds to a target bolt stretch of a workpiece rotated by the operative head.

9. An apparatus comprising:

a power wrench including an operative head for turning a rotatable workpiece;

a pressure sensor operatively connected to the power wrench, the pressure sensor measuring a pressure against the operative head;

an angular encoder operatively connected to the power wrench and configured to determine an angular position of one of the operative head and the rotatable workpiece relative to an origin;

a controller operatively connected to the power wrench, the pressure sensor, and the angular encoder, wherein the controller is configured to:

direct the operative head to turn in response to turn in response to a pressure-angle derivative of the operative head being below a predetermined threshold, wherein the pressure-angle derivative is defined as a change in pressure against the operative head arising from a change to an angular position of the operative head of the power wrench, define an origin at an angular position of the operative head where the pressure-angle derivative of the operative head exceeds the predetermined threshold, direct the power wrench to turn by an angular step in response to: (a) the pressure-angle derivative of the operative head exceeding the predetermined threshold, and (b) an angular differential of the operative head being less than a target value, wherein the angular differential represents an total amount of rotation of the operative head from the origin, and direct the operative head to cease turning in response to the angular differential of the operative head being approximately equal to or greater than the target value, wherein the controller is further configured to direct the operative head to decouple from the rotatable workpiece in response to the pressure-angle derivative of the operative head exceeding the predetermined threshold and the angular differential of the operative head from the origin being approximately equal to or greater than the target value, wherein the controller is further configured to:

determine whether a pressure against the operative head is outside a tolerance band in response to the angular differential being approximately equal to or greater than the target value, and direct the operative head to turn by an angular correction, before the decoupling of the operative head, in response to the pressure against the operative head being outside the tolerance band.

10. The apparatus of claim 9, wherein the power wrench comprises a hydraulic wrench.

11. The apparatus of claim 9, wherein the rotatable workpiece includes one of a locking nut and a non-locking nut of a turbine assembly.

12. The apparatus of claim 9, wherein the angular step comprises one of a plurality of angular steps, wherein each of the plurality of angular steps imparts a predetermined pressure differential onto the operative head.

13. The apparatus of claim 9, wherein the pressure sensor comprises an internal pressure sensor of the power wrench.

14. The apparatus of claim 9, wherein the target value of the angular differential corresponds to a predetermined bolt stretch of the rotatable workpiece.

15. The apparatus of claim 9, wherein the tolerance band comprises a pressure differential of at most approximately ten percent from a target pressure.

16. A system comprising:

a hydraulic wrench, wherein the hydraulic wrench further includes a hydraulic fluid pressure sensor, an angular encoder, an operative head for turning a rotatable workpiece; and a controller operatively connected to the hydraulic wrench and configured to perform actions including:

turning the rotatable workpiece with the operative head in response to a pressure-angle derivative of the operative head being below a predetermined threshold, wherein the pressure-angle derivative is defined as a change in pressure against the operative head arising from a change to an angular position of the operative head of the power wrench, defining an origin at a position where the pressure-angle derivative of the operative head exceeds the predetermined threshold, turning the rotatable workpiece with the operative head by an angular step in response to: (a) the pressure-angle derivative of the power wrench exceeding the predetermined threshold, and (b) an angular differential of the operative head being less than a target value, wherein the angular differential represents an total amount of rotation of the operative head from the origin, and decoupling the operative head from the rotatable workpiece in response to the pressure-angle derivative of the operative head exceeding the predetermined threshold and the angular differential of the operative head from the origin being approximately equal to or greater than a target value wherein the controller is further configured to perform actions including:

determining whether the pressure against the operative head is outside a tolerance band in response to the angular differential being approximately equal to or greater than the target value, and turning the operative head by an angular correction, before the decoupling of the operative head, in response to the pressure against the power wrench being outside the tolerance band.

* * * * *